US006603372B1

(12) United States Patent
Ishizaki et al.

(10) Patent No.: US 6,603,372 B1
(45) Date of Patent: Aug. 5, 2003

(54) LAMINATED NOTCH FILTER AND CELLULAR PHONE USING THE SAME

(75) Inventors: Toshio Ishizaki, Hyogo (JP); Ikuo Awai, Yamaguchi (JP); Hideyuki Miyake, Osaka (JP); Shoichi Kitazawa, Hyogo (JP); Toru Yamada, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/722,734

(22) Filed: Nov. 28, 2000

(30) Foreign Application Priority Data

Nov. 29, 1999 (JP) ..... 11-337114

(51) Int. Cl.[7] ..... H01P 1/203
(52) U.S. Cl. ..... 333/204; 333/205
(58) Field of Search ..... 333/204, 205, 333/219, 246, 185, 175

(56) References Cited

U.S. PATENT DOCUMENTS

| | | | | |
|---|---|---|---|---|
| 5,323,128 A | | 6/1994 | Ishizaki et al. | 333/204 |
| 5,719,539 A | * | 2/1998 | Ishizaki et al. | 333/204 |
| 6,140,891 A | | 10/2000 | Nakakubo et al. | 333/204 |

FOREIGN PATENT DOCUMENTS

| | | |
|---|---|---|
| EP | 0837517 | 4/1998 |
| EP | 0939449 | 9/1999 |
| JP | 7-312503 | 11/1995 |
| JP | 2606044 | 2/1997 |
| JP | 10178302 | 6/1998 |

OTHER PUBLICATIONS

Article entitled "A Very Small Dielectric Planar Filter for Portable Telephones" by Ishizaki et al., IEEE Trans on Microwave Theory and Techniques, vol. 42, No. 11, Nov. 1994, pp. 2017–2022.

Article entitled "Study of a Laminated Band Elimination FilterComprising Coupled–Line Resonators Using Low Temperature Co–Fired Ceramics" by Miyake et al., IEICE Trans. Electron., vol. E82 C No. 7, Jul. 1999, pp. 1104–1109.

Article entitled "Realization of Dual Mode Band Rejection Filters" by Snyder, Proceedings of IEEE Microwave Theory and Tech., pp. 264–268, 1979.

* cited by examiner

*Primary Examiner*—Robert Pascal
*Assistant Examiner*—Stephen E. Jones
(74) *Attorney, Agent, or Firm*—Greenblum & Bernstein, P.L.C.

(57) ABSTRACT

A notch filter made up from laminated dielectric, which attenuates a specific frequency of a signal to be transmitted, comprises two terminals for input or output a signal to be transmitted, a line connected between those terminals, two resonators each having one end connected to ground and an other end, two first coupling capacitors, and a second coupling capacitor. Each end of the line is connected to the other end of the resonator through the first capacitor. The second capacitor couples said two resonators each other.

18 Claims, 6 Drawing Sheets

LAMINATED NOTCH FILTER AND CELLULAR PHONE USING THE SAME

BACKGROUND OF THE INVENTION

1. Field of the Invention

The present invention relates to a laminated notch filter mainly used in a high frequency appliance such as a mobile communication apparatus, and a cellular phone using the same.

2. Related Art

Recently, laminated notch filters have become used in various wireless apparatus, especially in cellular phones. Referring now to the drawing, an example of conventional laminated notch filter is explained.

FIG. 7 is an equivalent circuit diagram of a conventional laminated notch filter. In FIG. 7, the notch filter comprises two input/output terminals 1, two coupling capacitors 2 and two quarter wavelength resonators 3. One end of each coupling capacitor 2 is coupled to open ends of the quarter wavelength resonators 3. The two coupling capacitors 2 are connected almost in cascade through an inter-stage coupling line 4 which has a length of a quarter wavelength. The quarter wavelength resonators 3 can be mutually coupled by electromagnetic coupling (The electromagnetic coupling is symbolically described as "C" in the drawing).

The operation of the laminated notch filter having such a structure is explained below.

First, since the input/output terminals 1 are connected through the inter-stage coupling line 4, signals of ordinary frequency are transmitted without being affected. That is, hardly any insertion loss occurs. By contrast, at a specific frequency at which series resonance occurs in a series circuit of the coupling capacitors 2 and the quarter wavelength resonators 3, a signal to be transmitted is connected to the ground with nearly zero impedance, and is thus hardly transmitted. That is, at the frequency of series resonance, ideally, the amount of attenuation is infinite (for example, see Japanese Patent Laid-Open Publication No. 10-178302).

However, this ideal is realized only when the electromagnetic coupling between the resonators can be ignored, for example, in case that coaxial resonators are used, or when strip line resonators are spaced by a sufficient distance.

Generally, when a length of the inter-stage coupling line 4 is as short as a quarter wavelength, the electromagnetic coupling C occurs between the resonators 3. The electromagnetic coupling C between resonators 3 results in deterioration of the attenuation amount according to the intensity of the coupling, as shown in FIG. 8 (that is, attenuation amount diminishes as the coupling amount increases). Thus, for the structure in which the electromagnetic coupling C between resonators 3 can not be ignored, the attenuation amount varies. Therefore, there is a problem in that a small size notch filter with favorable attenuation characteristic cannot be obtained.

SUMMARY OF THE INVENTION

In the light of such problems, the aim of the present invention is to provide a small-sized laminated notch filter having a favorable attenuation characteristic even though the electromagnetic coupling between resonators can not be ignored.

In a first aspect of the invention, a notch filter is made up of laminated dielectric, and attenuates a specific frequency of a signal to be transmitted. The notch filter comprises two terminals to input or output a signal to be transmitted, a line connected between those terminals, two resonators each having one end connected to ground and an other end, two first coupling capacitors, and a second coupling capacitor. Each end of the line is connected to another end of each resonator through the first capacitor. The second capacitor couples the two resonators to each other.

In such a first notch filter, an attenuation frequency of the notch filter may be equal to an anti-resonance frequency of a parallel circuit of the second capacitor and an equivalent circuit which is obtained by taking, as a circuit, the electromagnetic coupling between the resonators.

In a second aspect of the invention, a notch filter is made up of laminated dielectric, and attenuates a specific frequency of a signal to be transmitted. The notch filter comprises two terminals to input or output a signal to be transmitted, a line connected between those terminals, two stepped impedance resonators each having a low impedance portion end a high impedance portion, and two coupling capacitors. Electromagnetic coupling in the two stepped impedance resonators is adjusted by controlling electromagnetic coupling between the low impedance portions and electromagnetic coupling between the high impedance portions, respectively.

In such a second notch filter, the stepped impedance resonators may be controlled such that an attenuation frequency of the notch filter is equal to an anti-resonance frequency of an equivalent circuit which is obtained by taking, as a circuit, electromagnetic coupling between the low impedance portions and electromagnetic coupling between the high impedance portions in the resonators.

In a third aspect of the invention, a notch filter is made up of laminated dielectric, and attenuates a specific frequency of a signal to be transmitted. The notch filter comprises two terminals for input or output of the signal to be transmitted, a line connected between those terminals, length of the line being shorter than an eighth of a wavelength of the signal to be transmitted, two resonators each having one end connected to ground and another end, and two coupling capacitors. Each end of the line is connected to another end of a resonator through the coupling capacitor.

In a fourth aspect of the invention, a cellular phone comprises a circuit for amplifying a signal and the notch filter according the present invention. The filter attenuates a specific frequency of the signal output from or input to the circuit.

According to the invention, the laminated notch filter of small size and with large attenuation can be obtained. Further, by using the notch filter according to the invention, a cellular phone having small size and high performance can be obtained.

DESCRIPTION OF THE PREFERRED EMBODIMENTS

Figure 1A:
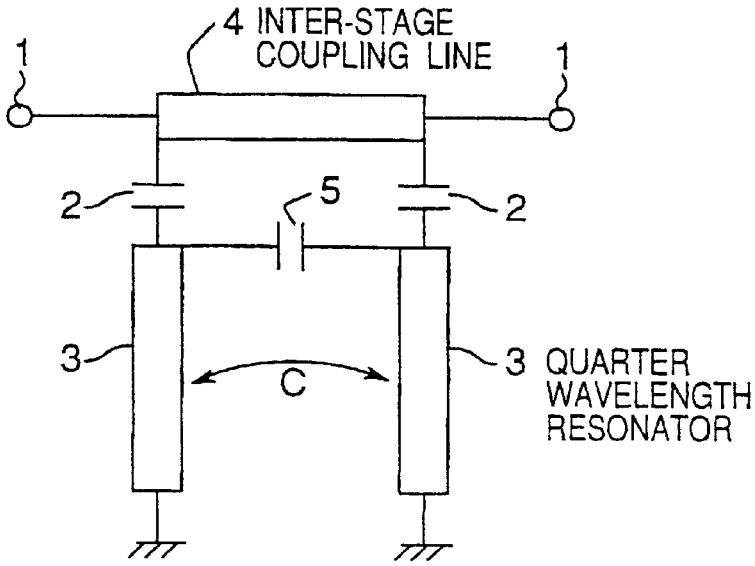
FIG. 1A is an equivalent circuit diagram of a laminated notch filter in a first embodiment of the invention.

Referring now to the drawings, embodiments of the laminated notch filter of the present invention are explained below.

First Embodiment

FIG. 1A is an equivalent circuit diagram of a laminated notch filter in a first embodiment of the invention. In FIG. 1A, the laminated notch filter comprises two input/output terminals 1, two coupling capacitors 2, two quarter wavelength resonators 3, an inter-stage coupling line 4, and an inter-stage coupling capacitor 5. An electromagnetic coupling C occurs between resonators 3.

The input/output terminal 1 is a terminal to input or output a signal to be transmitted on the inter-stage coupling line 4. Each end of the line 4 connected between the input/output terminal 1 is connected to a resonator 3 through a coupling capacitor 2. The coupling capacitor 5 is coupled between nodes which connects the resonator 3 and the coupling capacitor 2. One end of each of the resonators 3 that is not connected to the coupling capacitor 2 is connected to ground.

Figure 2:
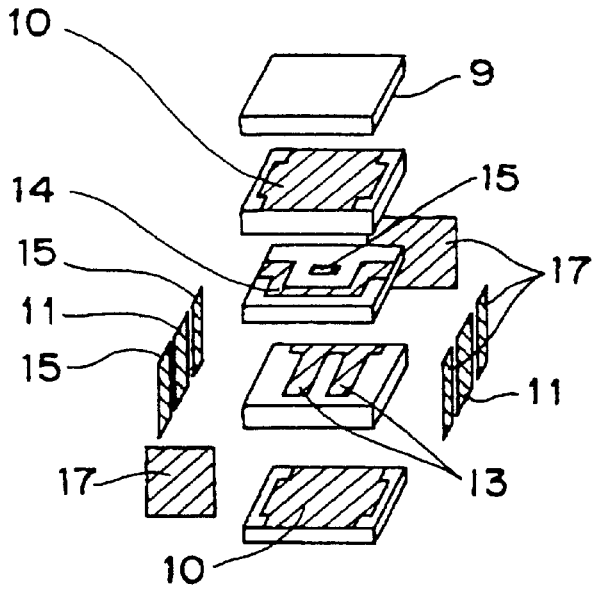
FIG. 2 is a diagram showing a laminated structure of the notch filter according to the invention.

The notch filter according to the embodiment has a laminated structure of ceramics sintered at low temperature. FIG. 2 shows a laminated structure of the notch filter. The laminated notch filter has a five layer structure. The laminated notch filter is formed by stacking a dielectric sheet 9 made up of low temperature sintered ceramic, a dielectric sheet on which a shield electrode 10 is formed, a dielectric sheet on which a main line 14 and inter-stage coupling capacitor 15 are formed, and a dielectric sheet on which a shield electrode 10 is formed. The laminated notch filter further comprises input/output electrode 11 and ground electrode 17. The input/output electrode 11, the line 14 and inter-stage coupling capacitor 15 correspond to the input/output terminal 1, the line 4, and the coupling capacitor 5 as shown in FIG. 1A, respectively. It is noted that notch filters described in other embodiments of the invention are also made of dielectric laminated ceramics, in addition to the filter of this embodiment.

The operation of the laminated notch filter having such a structure is explained below.

In FIG. 1A, the circuit excluding the inter-stage coupling line 4 is considered to be equivalent in circuit structure to a band pass type dielectric filter disclosed, for example, in Japanese Patent Publication No. 2606044. This Publication discloses generating an attenuation pole near the pass band in the band pass filter by combining the electromagnetic coupling by the inter-stage coupling capacitors and the electromagnetic coupling between resonators. Infinite impedance caused by anti-resonance of series branches of the π shaped equivalent circuit allows the attenuation pole to be generated.

The notch filter according to this embodiment is based upon an idea that electromagnetic coupling between resonators 3 is superficially cancelled by making use of anti-resonance. That is, by providing a match between the anti-resonance frequency of series branches of the π shaped equivalent circuit and the attenuation frequency of the notch filter, a large attenuation can be obtained even though there is electromagnetic coupling C between resonators 3. The anti-resonance frequency of series branches of the π shaped equivalent circuit is equal to an anti-resonance frequency of the parallel circuit of the inter-stage coupling capacitor 5 and an equivalent circuit which is obtained by taking the electromagnetic coupling C between the resonators 3 as a circuit. The attenuation frequency of the notch filter is determined by the resonators 3.

The electromagnetic coupling C between resonators 3 becomes stronger as the laminated filter is smaller in size and the distance between the resonators becomes shorter, and hence the laminated notch filter with this structure is very useful in reducing the size of a cellular phone.

Figure 3:
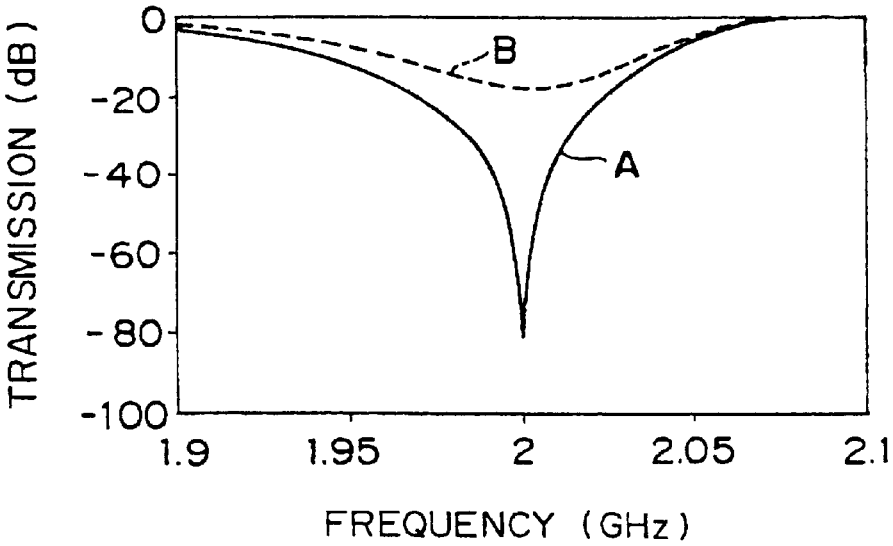
FIG. 3 is a diagram showing a transmission characteristic of the laminated notch filter of the first embodiment.

FIG. 3 shows a frequency characteristic of the notch filter according to the embodiment. In FIG. 3, curve A represents a frequency characteristic of the notch filter according to the embodiment with the coupling capacitor 5 for coupling resonators 3, while curve B represents a frequency characteristic of a conventional notch filter without the coupling capacitor 5. As shown in this figure, according to the laminated notch filter, the attenuation characteristic can be improved without affecting of the electromagnetic coupling.

Thus, according to the embodiment, the notch filter comprises plural quarter wavelength resonators mutually coupled in electromagnetic field, coupling capacitors and an inter-stage coupling line, which are formed in a low temperature sintered ceramic laminate. The quarter wavelength resonators are electrically connected through an inter-stage coupling capacitor. Hence, the laminated notch filter of small size and large attenuation can be obtained.

Figure 1B:
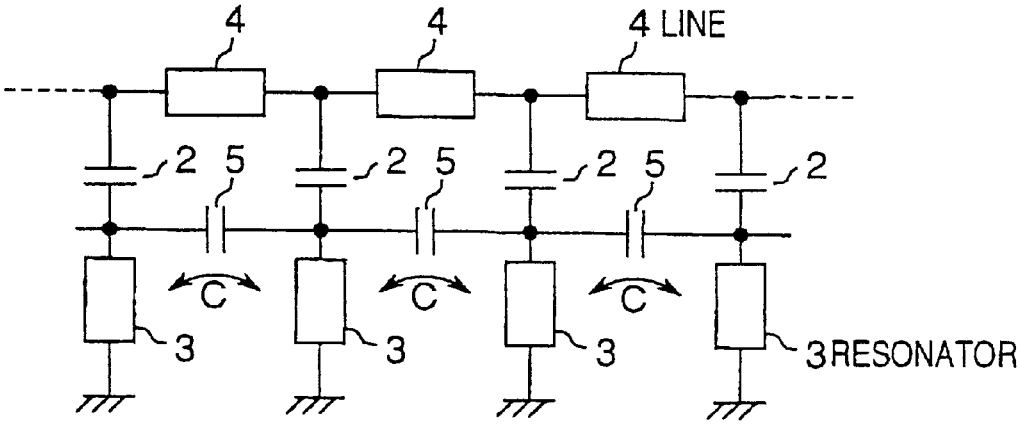
FIG. 1B is a diagram showing one example of application of the laminated notch filters in a first embodiment for lines in a plurality of stages.

Although the notch filter of two stages is described above, by applying the notch filter according to the invention to lines of a plurality of stages, the notch filter may have a structure as shown FIG. 1B with the same being true for the following embodiments.

Second Embodiment

A second embodiment of the notch filter according to the invention is described below with reference to the accompanying drawing.

Figure 4:
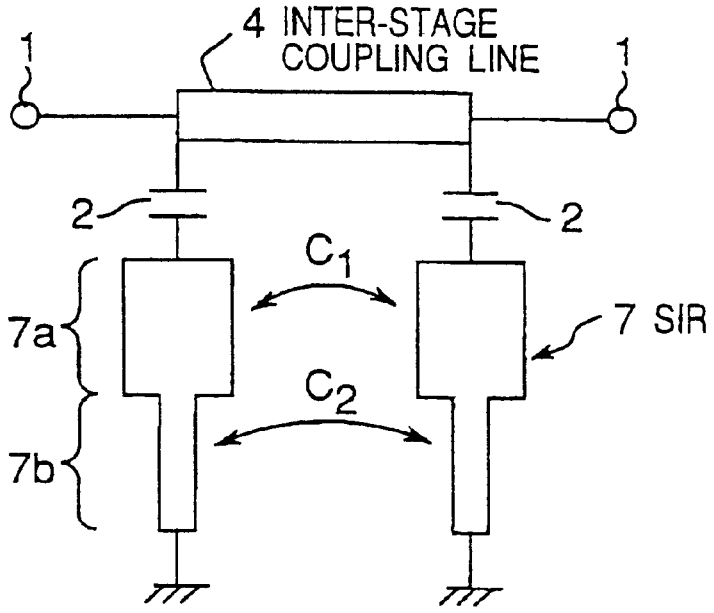
FIG. 4 is an equivalent circuit diagram of a laminated notch filter in a second embodiment of the invention.
Figure 7:
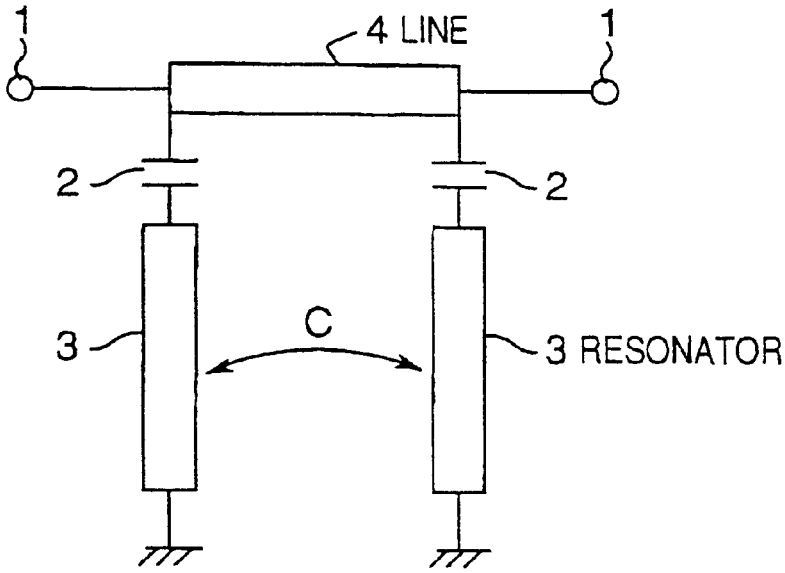
Fig.7 PRIOR ART
FIG. 7 is an equivalent circuit diagram of a conventional laminated notch filter.
Figure 8:
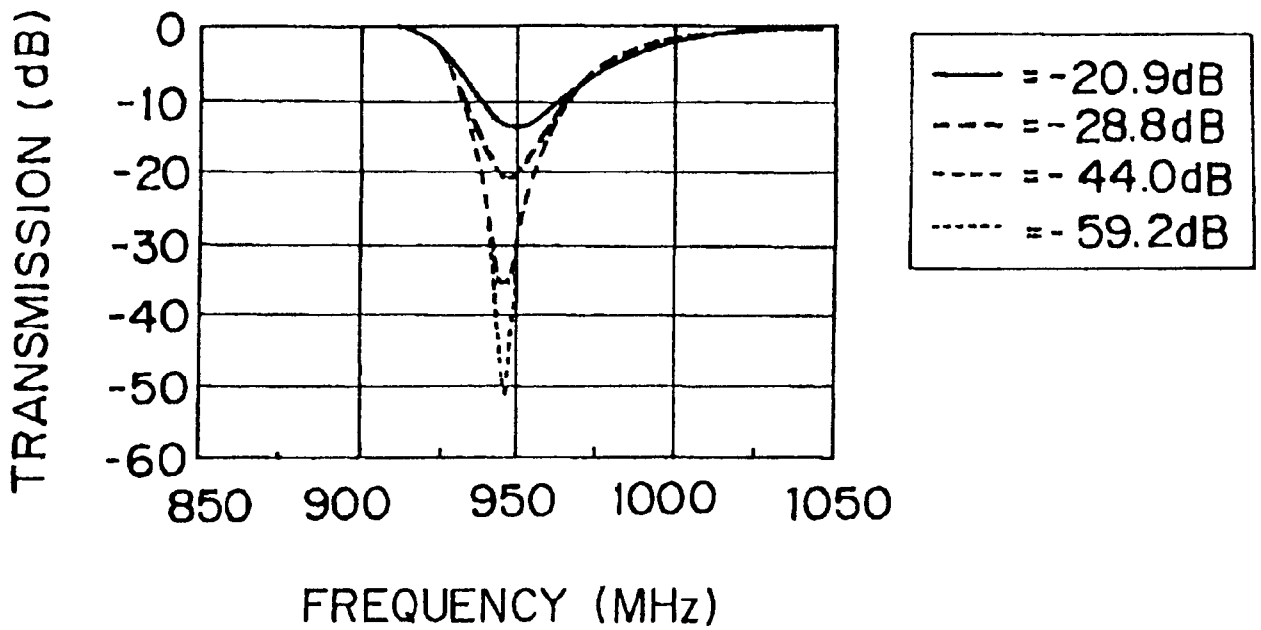
Fig.8 PRIOR ART
FIG. 8 is a diagram showing a transmission characteristic of the conventional laminated notch filter.

FIG. 4 is an equivalent circuit diagram of a laminated notch filter of this embodiment. As shown in FIG. 4, the notch filter of this embodiment uses stepped impedance resonators (SIR) 7 instead of the quarter wavelength resonators 3 in the notch filter as shown in FIG. 7.

The SIR 7 comprises a low impedance portion 7*a* and a high impedance portion 7*b*. Between the two SIRs 7, electromagnetic coupling $C_1$ and $C_2$ are generated at the low impedance portions 7*a* and the high impedance portions 7*b*, respectively. Values of the electromagnetic coupling $C_1$ or $C_2$ can be adjusted by controlling the respective impedance for the low impedance portion 7*a* or the high impedance portion 7*b*.

For a laminated notch filter having such a structure, the operation thereof is explained below.

In FIG. 4, the circuit excluding the inter-stage coupling line 4 is considered to be equivalent in circuit structure to a band pass type dielectric filter disclosed, for example, in Japanese Patent Laid-Open Publication No. 7-312503. This Publication discloses controlling coupling amount between low impedance portions and coupling amount between high impedance portions respectively by using SIRs in order to generate an attenuation pole around a passing band in the band pass filter.

The notch filter of this embodiment applies the above teaching to a notch filter. The notch filter independently controls the coupling amount of the electromagnetic coupling C1 between low impedance portions 7*a* of the SIR 7 and the coupling amount of the electromagnetic coupling C2 between high impedance portions 7*b* of the SIR 7 so as to provide an anti-resonance frequency of series branches of the π shaped equivalent circuit to an attenuation frequency of the notch filter. Hence, just as in the first embodiment, the electromagnetic coupling between resonators can be canceled superficially, and a large attenuation can be provided even though electromagnetic coupling exists between resonators 7. The anti-resonance frequency of series branches of the π shaped equivalent circuit is equal to an anti-resonance frequency of an equivalent circuit which is obtained by taking, as a circuit, the electromagnetic coupling $C_1$ between the low impedance portions 7*a* and the electromagnetic coupling $C_2$ between the high impedance portions 7*b* in the SIRs 7.

As described above, the notch filter has the structure comprising plural impedance step type resonators (SIR) mutually coupled in electromagnetic field, coupling capacitors, and an inter-stage coupling line, which are made up of a low temperature sintered ceramic laminate. Further, the electromagnetic coupling amount between low impedance portions of the SIRs 7 and the electromagnetic coupling amount between high impedance portions of the SIRs 7 are independently controlled. Thus, a laminated notch filter having small size and large attenuation can be obtained.

Third Embodiment

A third embodiment of the invention is described below with reference to the accompanying drawing.

Figure 5:
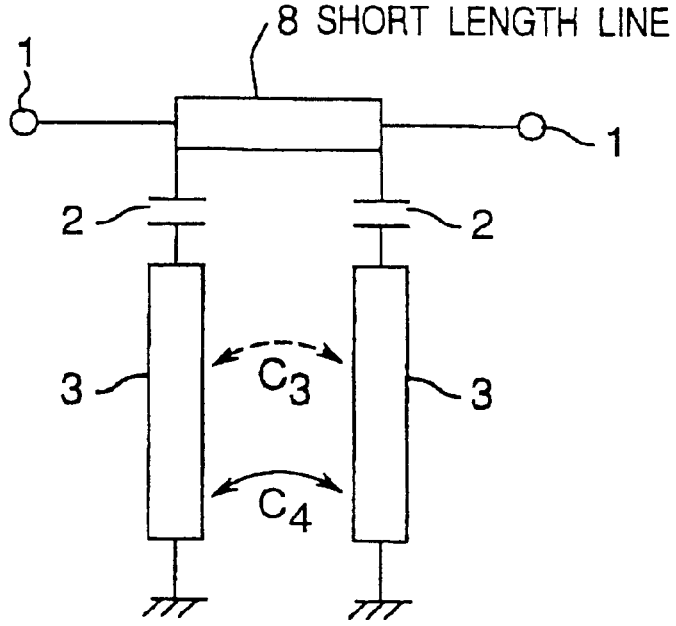
FIG. 5 is an equivalent circuit diagram of a laminated notch filter in a third embodiment of the invention.

FIG. 5 is an equivalent circuit diagram of a laminated notch filter in the third embodiment of the invention. The notch filter as shown in FIG. 5 has the same structure as the notch filter of the first embodiment except for a short length inter-stage coupling line 8 instead of the inter-stage coupling line 4 and the lack of the inter-stage coupling capacitor 5. The length of the short length inter-stage coupling line 8 is less than an eighth of the wavelength.

In the notch filter circuit, usually, a transmission line of nearly a quarter wavelength is used as the inter-stage coupling line. Varying length of the inter-stage coupling line from a quarter wavelength generates apparent coupling $C_3$ between resonators 3. Therefore, in this embodiment, the inherent coupling $C_4$ generated by the electromagnetic coupling between the resonators 3 is canceled by the apparent coupling $C_3$ generated by varying the length of the inter-stage coupling line from a quarter wavelength. Particularly, the effect of canceling the coupling becomes large in cases where the length of the coupling line is shorter than a eighth of the wavelength. Therefore, using the short length inter-stage coupling line with a eighth of the wavelength can recover the attenuation amount which is deteriorated by the electromagnetic coupling C between resonators 3. The notch filter of this embodiment may also include an inter-stage capacitor as shown in the first embodiment.

As described above, the notch filter has a structure comprising plural quarter wavelength resonators mutually coupled in an electromagnetic field, coupling capacitors and an inter-stage coupling line having length shorter than ⅛ wavelength, which are formed in a low temperature sintered ceramic laminate. The electromagnetic couplings between the quarter wavelength resonators are equivalently canceled by way of the short inter-stage coupling line. Thus, the laminated notch filter of small size and large attenuation can be obtained.

Fourth Embodiment

Figure 6:
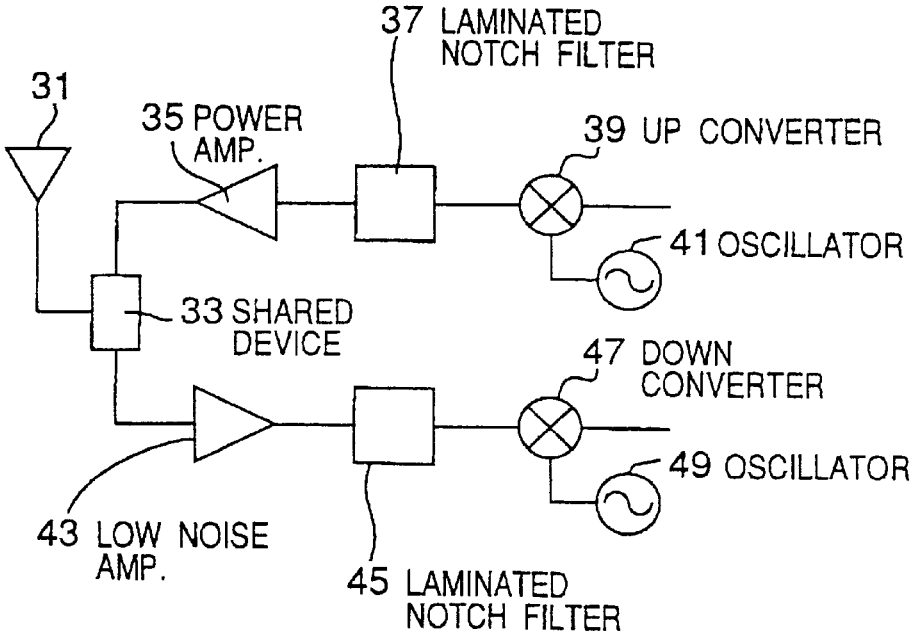
FIG. 6 is a diagram showing an application of the laminated notch filters according to the invention in a cellular phone.

The notch filters described above are applicable to several electronic apparatuses, for example, a cellular phone. The notch filter suppresses only unnecessary signals which are generated within the cellular phone or are externally generated, and transmits a necessary signal with little loss. The notch filters can be used in various parts of the cellular phone. FIG. 6 shows one example of the usage of the notch filters in the cellular phone. FIG. 6 is a diagram showing a part of structure of the cellular phone using any of the notch filters of the above-described embodiments.

In FIG. 6, a signal received in an antenna 31 is amplified in a low noise amplifier 43. An unnecessary frequency component of the amplified signal is attenuated in a notch filter 45. Subsequently the signal is fed into a down converter 47. In the down converter 47, the signal is converted to a desired frequency which is determined by an oscillator 49. Then, predetermined processes such as demodulation are applied to the signal to convert the signal to an audio signal. For transmitting, an up converter 39 generates a signal to be transmitted based on a frequency determined by an oscillator 41 and a modulation signal provided by a pre-stage circuit. An unnecessary frequency component is removed from the signal to be transmitted by a laminated notch filter 37, is amplified by a power amplifier 35, and transmitted through a shared device 33 from the antenna 35.

Thus, applying the notch filter according to the invention to a cellular phone allows the cellular phone to be compact and have high performance.

Although the present invention has been described in connection with specified embodiments thereof, many other modifications, corrections and applications are apparent to those skilled in the art. Therefore, the present invention is not limited by the disclosure provided herein but limited only to the scope of the appended claims.

What is claimed is:

1. A laminated dielectric notch filter, which attenuates a frequency of a signal to be transmitted, the notch filter comprising:

two terminals configured to input and output a signal to be transmitted;

a line connected between the two terminals;

two resonators positioned so as to have an electromagnetic coupling, each resonator having a first end connected to ground and a second end;

two first coupling capacitors; and a second coupling capacitor, wherein each end of the line is connected to the second end of a corresponding one of the two resonators through a corresponding one of the two first coupling capacitors, and the second coupling capacitor couples the two resonators.

2. The notch filter according to claim 1, wherein an attenuation frequency of the notch filter is substantially equal to an anti-resonance frequency of a parallel circuit comprising the second coupling capacitor and an equivalent circuit which results in electromagnetic coupling between the two resonators.

3. A cellular phone comprising:

a circuit that amplifies a signal; and the notch filter according to claim 1, which attenuates a specific frequency of the signal at least one of input to and output from the circuit.

4. A laminated dielectric notch filter, which attenuates a frequency of a signal to be transmitted, the notch filter comprising:

two terminals configured to input and output a signal to be transmitted;

a line connected between the two terminals;

two stepped impedance resonators each having a low impedance portion and a high impedance portion; and two coupling capacitors, wherein the stepped-impedance resonators anti-resonate at a frequency substantially the same as the attenuation frequency.

5. The notch filter according to claim 4, wherein an amount of electromagnetic coupling between the two stepped impedance resonators is predetermined such that the attenuation frequency of the notch filter is substantially equal to an anti-resonance frequency of an equivalent circuit which results in electromagnetic coupling between the two resonators.

6. The notch filter according to claim 4, wherein the electromagnetic coupling comprises electromagnetic coupling between the low impedance portions of the two resonators and electromagnetic coupling between the high impedance portions of the two resonators.

7. A cellular phone comprising:

a circuit that amplifies a signal; and the notch filter according to claim 4, which attenuates a specific frequency of the signal at least one of input to and output from the circuit.

8. A laminated dielectric notch filter, which attenuates a frequency of a signal to be transmitted, the notch filter comprising:

two terminals configured to input and output a signal to be transmitted;

a line connected between the two terminals;

two resonators positioned so as to have an electromagnetic coupling, each resonator having a first end connected to ground and a second end; and two first capacitors, each electrically connecting an end of the line to the second end of a corresponding one of the two resonators;

wherein the notch filter is configured to anti-resonate at a frequency substantially the same as the attenuation frequency of the notch filter.

9. The notch filter according to claim 8, wherein the anti-resonance is associated with the electromagnetic coupling of the two resonators.

10. The notch filter according to claim 8, the two resonators being positioned without an intervening shield electrode therebetween that substantially blocks electromagnetic coupling.

11. The notch filter according to claim 8, further comprising a second capacitor connected between the two resonators.

12. The notch filter according to claim 11, the second capacitor comprising an electrode confronting the two resonators.

13. The notch filter according to claim 8, wherein an additional electromagnetic coupling is generated by each of the resonators being configured to have a stepped-impedance-shape having a low impedance portion and a high impedance portion.

14. The notch filter according to claim 13, the anti-resonance frequency being predetermined based upon an electromagnetic coupling amount of the low impedance portions of the resonators and by an electromagnetic coupling amount of the high impedance portions of the resonators.

15. A cellular phone comprising:

a circuit that amplifies a signal; and the notch filter according to claim 8, which attenuates a frequency of the signal at least one of input to and output from the circuit.

16. A laminated dielectric filter comprising a coupled plurality of the laminated dielectric notch filters of claim 8.

17. The laminated dielectric filter according to claim 16, wherein a transmission of a signal is substantially prevented over a band-elimination bandwidth.

18. The notch filter according to claim 8, wherein the line connected between the two terminals has a length shorter than one-eighth a wavelength of the signal to be transmitted.

* * * * *